US005367734A

United States Patent [19]

Terry

[11] Patent Number: 5,367,734

[45] Date of Patent: Nov. 29, 1994

[54] PLIABLE ABRASIVE PELLET FOR ABRADING FABRICS

[76] Inventor: Raymond Terry, Post Office Box 2, Pickwick Dam, Tenn. 38365

[21] Appl. No.: 113,612

[22] Filed: Aug. 27, 1993

Related U.S. Application Data

[63] Continuation of Ser. No. 787,554, Nov. 4, 1991, abandoned.

[51] Int. Cl.[5] ..... B24B 1/00

[52] U.S. Cl. ..... 8/159; 8/158; 51/298; 451/33

[58] Field of Search ..... 8/158, 159; 51/314, 51/298

[56] References Cited

U.S. PATENT DOCUMENTS

| | | | |
|---|---|---|---|
| 2,978,850 | 4/1961 | Gleszer | 51/282 |
| 3,959,434 | 5/1976 | Squier | 264/45.8 |
| 4,575,887 | 3/1986 | Viramontes | 8/158 |
| 4,750,227 | 6/1988 | Hopkins et al. | 8/158 |
| 4,751,138 | 6/1988 | Tumey et al. | 428/323 |
| 4,765,100 | 8/1988 | Majors | 51/313 |
| 4,845,790 | 7/1989 | Brasington | 8/150 |
| 4,912,056 | 3/1990 | Olsen | 435/263 |
| 4,954,138 | 9/1990 | Butcher et al. | 51/293 |
| 4,966,609 | 10/1990 | Callinan et al. | 51/295 |

FOREIGN PATENT DOCUMENTS 3129699 2/1983 Germany .

*Primary Examiner*—Anthony McFarlane
*Assistant Examiner*—Nhat D. Phan
*Attorney, Agent, or Firm*—Luedeka, Neely & Graham

[57] ABSTRACT

An improved abrasive pellet for use in abrading fabrics during a wash cycle. A pellet is formed of a mixture of plastic Yesin, piasticizer resin and abrasive filler mixed at temperature sufficient to maintain the mixture as a liquid. The mixture is then extruded through a die of a desired shape and cut so that a pellet of desired cross-sectional shape and size is formed. The pellet is hard at room temperature, but becomes pliant at normal wash water temperatures. The abrasive filler provides the desired abrasive qualities in the pellet.

8 Claims, 1 Drawing Sheet

PLIABLE ABRASIVE PELLET FOR ABRADING FABRICS

This is a continuation of application Ser. No. 07/787,554, filed Nov. 4, 1991 now abandoned.

FIELD OF THE INVENTION

This invention relates to the field of abrasive washing of fabrics and particularly to the abrading of fabrics during a wash cycle by the addition of abrasive pellets to the wash water.

BACKGROUND OF THE INVENTION

The use of abrasive washing techniques to achieve a desired "aging" of fabrics has long been known. The oldest and most widely used washing technique has been to add a certain amount of pumice stone to a washing machine and to wash the fabric in the presence of the pumice. However, this procedure has many drawbacks.

The pumice has a tendency to be ground to fine grit and break apart during use. The grit is very abrasive and serves to shorten the working life of moving washing machine parts. Furthermore, the clothes must be cleaned and processed to remove the grit after the abrasive process has been completed.

Also, as the stones break, the pieces are not of a uniform same size and often have shard edges or points. The non-uniform size of the stones leads to unpredictable fading of the fabric which can result in undesirable streaks or patterns in the fabric. The sharp edges or corners can also lead to the tearing or cutting of the fabric, making such damaged pieces unmerchantable.

Finally, the pumice stone has a relatively short life span and must be replaced frequently. Typically, pumice stone will only last for 2–3 wash cycles.

There have been many procedures developed to replace the requirement for pumice stones in a stone washing process. The various procedures take two basic approaches to the problem: chemical wash processes with no abrasive elements and/or replacement of pumice stone with a substitute abrasive number. The chemical procedures generally achieve good uniformity in the fading of the fabrics. However, the chemical processes have to date been unable to achieve the desired fabric texture, and the fading caused by the chemical processes does not quite duplicate the appearance of that achieved by pumice stones.

There have been attempts to develop abrasive members which provide some of the sought after improvements. Some processes have utilized a grit added to the wash which enhances uniformity and texture, but retains all of the problems of the Grit which is associated with pumice stones.

Another approach has been to manufacture artificial abrasive members or stones. German Patent No. 3,129,669, issued to Maruo Clothing, Inc., described the use of pieces of metal or hard plastic in place of stone. However, the surface of hard plastic is generally smooth and therefore lacks sufficient abrasive characteristics.

Another type of abrasive member was disclosed in U.S. Pat. No. 4,750,227 issued to Hopkins, et al. The abrasive member taught by Hopkins is a rigid block of material made of organic fibers covered by a resilient abrasive layer which is adhered to the rigid block. One problem with this product is that the outer or abrasive layer is subject to wear and the inner rigid block has different abrasive characteristics from the outer resilient layer. Therefore, this abrasive member is still subject to a shortened life span to avoid uneven abrasion of fabrics as the member wears.

It is therefore an object of the invention of a preferred embodiment to achieve the desired abrasion effects of pumice stone while providing uniformity of abrasion and wear and an extended operational life.

It is a further object of the invention to provide an artificial abrasive pellet which becomes pliable at wash water temperatures to enhance abrasion of fabrics.

It is a further object of the invention to provide an abrasive pellet which can be produced in a variety of shapes and sizes in order to achieve the desired abrasion affects.

It is a further object of this invention to provide an abrasive member of uniform composition throughout so that the abrasive characters remain uniform as it wears, thus extending its useful life.

SUMMARY OF THE INVENTION

This invention relates to an abrasive member for use in washing process designed to age fabrics so as to fade their colors and/or soften them. In the preferred embodiment the pellet is formed of a mixture comprised of a plastic resin, a plasticizer and an abrasive filler. These elements are combined at a temperature sufficient to maintain the mixture in a liquid state. The mixture is then extruded through a die having a cross-sectional shape corresponding to that desired of the abrasive member. The extrusion is then cut periodically so that the members are of the desired length. The composition of the elements of the mixture is such that the abrasive member is hard at room temperature, but becomes pliable at normal wash water temperatures.

In a preferred embodiment of the disclosed invention, the preferred plastic resin is a PVC (polyvinyl chloride) resin, the preferred plasticizer is Eastman DOTP plasticizer and the preferred abrasive filler is aluminum trihydrate or calcium carbonate. In a preferred embodiment, the elements of the mixture are selected such that the member has a pliability at wash water temperatures similar to that of pencil eraser.

In a preferred embodiment the mixture is comprised of between about 45–53% PVC resin, 17–27% plasticizer, and 25–35% abrasive filler.

In a preferred embodiment, the mixture is maintained at a temperature during the extrusion process so that bubbles remain in the mixture as the pellet is extruded; to provide that the pellet is porous throughout.

BRIEF DESCRIPTION OF THE DRAWINGS

The above-described features of the present inventions may best be understood with reference to the following detailed description and drawings in which.

DETAILED DESCRIPTION OF AN PREFERRED EMBODIMENT

Figure 1:
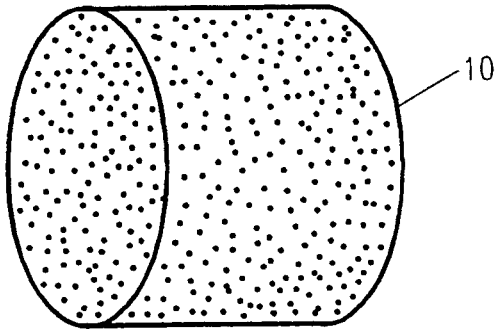
FIG. 1 is a view of preferred pellet.

Referring now to the FIGURES in which like reference numerals indicate like or corresponding features throughout the FIGURES, there as shown in FIG. 1 a preferred pellet 10. The preferred pellet is pliable and has a circular cross-section. The form of the pellet 10 is cylindrical and it is preferably formed such that it has a porous composition in order to enhance its abrasive characteristics.

The pellet 10 is made by heating plastic resin to its melting point and then adding a plasticizer and an abrasive filler. The components are mixed at a temperature which is sufficient to maintain the mixture in a liquid state. The mixture is then extruded at a temperature such that bubbles are maintained in the mixture which will give the pellet the desired porous consistency upon extrusion.

The porous nature of the pellet 10 insures that as it wears, the abrasive characteristics will remain uniform. For example, instead of becoming smooth as it wears, new porous portions of the pellet are exposed during the wearing process which exposes further abrasive surfaces and the exterior of the pellet remains abrasive.

An example of the appropriate mixture of components and method of extrusion to obtain the preferred pellet 10 will now be described. Initially, a plastic resin, such as PVC resin, is mixed with a plasticizer and an abrasive filler, and the mixture is heated to a temperature generally above about 300° F. Sufficient quantities of each component are added so that the final mixture is between about 43% and 53% PVC resin, 17% and 27% plasticizer, and 25% and 35% abrasive filler by weight. The mixture is then extruded through commercially available plastic extrusion equipment, at a temperature of between about 310° to 320° F. At this temperature bubbles will form within the mixture and cause the extruded mixture to be porous.

Figure 2:
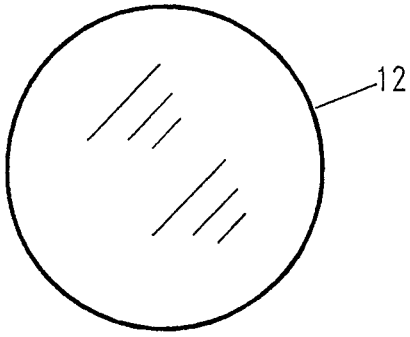
FIGS. 2 and 3 are cross-sectional views of preferred pellets.
Figure 3:
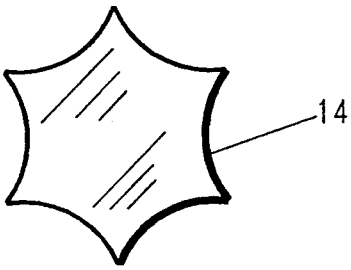
Figure 4:
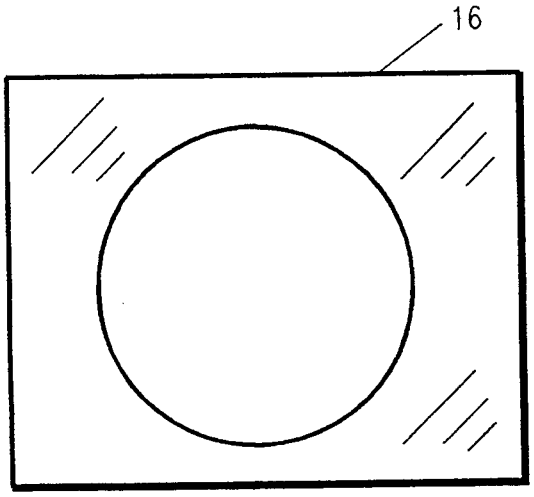
FIGS. 4 and 5 are views of dyes used to produce the pellets shown in FIGS. 2 and 3, respectively.
Figure 5:
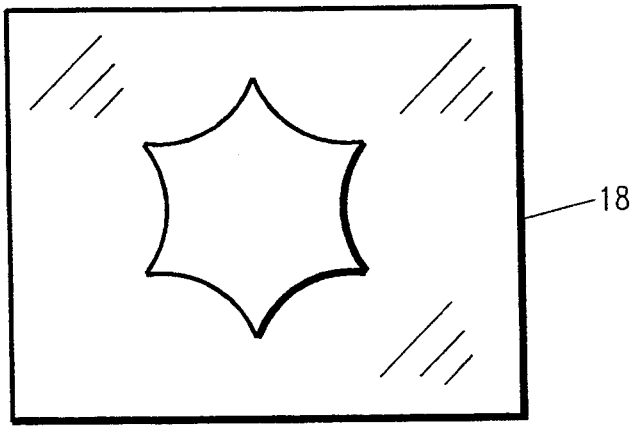

The liquid mixture is extruded through a die of appropriate cross-sectional characteristics. For example, if the desired pellet has a circular cross-section, as indicated in FIG. 2, then the die would have a circular opening, as shown in FIG. 4. Other shapes of pellet have been extruded to achieve various abrasive effects. An example of a 6-flanged pellet cross-section 14 and appropriate die 18 are shown in FIGS. 3 and 5. The extruded mixture is allowed to harden for approximately four hours and then is cut at predetermined lengths so as to provide a pellet of the desired size.

In a preferred embodiment, the preferred PVC resin is GEON 30 PVC resin manufactured by the B.F. Goodrich Co., Chemical Group. The preferred plasticizer is "KODAFLEX" DOTP plasticizer (bis (2-ethylhexyl) terephthalata) manufactured by Eastman Chemical Products Incorporated. The abrasive filler is preferably aluminum trihydrate or, alternatively, calcium carbonate. The pellet 10, generally has a preferred cross-sectional diameter between about ½ inch to 1½ inch and a preferred length between about ¾ inch and 1½ inch. A commercially available extruder capable of producing PVC rods can be fitted with the appropriate die and used in the production of pellets. Some representative extruder manufacturers are: AL-BE Industries; Cincinnati Milacron; Davis Standard; Olympia Tool & Machines; DOMINI, Inc.; and Tex America. Single or Twin Screw Extruders may be used.

A preferred pellet made in accordance with the present invention is, for example, made by combining 48% GEON 30 PVC resin, 22% Eastman DOTP plasticizer and 30% aluminum trihydrate. The composition is preferably extruded at a temperature of between about 310°–320° F. through a die having a ⅝ inch diameter circular opening. Upon hardening, the extruded rod is cut into approximately 1 inch pieces to form the completed pellets. Calcium carbonate or silica flour may be substituted for the aluminum trihydrate and, as was previously discussed, a variety of dies can be used to obtain different cross-sectional shapes and pellet diameters to achieve differing abrasion results.

The preferred pellet, when made as described herein has many characteristics which represent advances over prior art abrasive elements. The plasticizer resin provides that the pellet will become pliable at typical wash water temperatures around about 120°–150° F., and can withstand sustained temperatures of up to about 300° F. without melting. As a result, pellets which remain with the fabric during a dryer cycle will not melt. The pliable pellet achieves an increase in abrasion over a similar hard pellet or pumice; improvements as great as thirty percent (30%) have been observed.

Secondly, a pellet made in accordance with his invention has an effective life much greater than that of pumice stone or other artificial abrasive members. By way of comparison, pumice stones usually last between 2–14 washings while pellets made as described herein have lasted for as long as 200 washings without appreciable signs of wear. As was previously described, the porous nature of the pellet also enhances useful life in providing a uniformly abrasive exterior surface of the pellet even as the pellet wears.

As is common in the extrusion of plastics, the dies can easily be replaced to provide pellets with a variety of cross-sectional shapes. The lengths of the pellets are easily varied as well. Therefore, various pellets may be made in order to achieve various abrasive effects. In tests, it has been found that pellets with the aluminum trihydrate filler and a ⅝ inch diameter have the best abrasive characteristics but other size and filler combinations can be utilized to reduce cost or achieve different abrasion effects.

It should be recognized that the invention of the foregoing detailed description is capable of numerous modifications and substitutions without departing from the scope of the claims; therefore, it should be understood that the foregoing detailed description is provided for the purposes of illustration and not limitation.

What is claimed is:

1. A method for the abrasive treatment of fabrics comprising the steps of:

providing pliable plastic pellets, said pellets constructed of a plastic that is pliable in water that is sufficiently hot for washing fabrics and having an abrasive filler substantially uniformly distributed throughout said pellets, said abrasive filler being of sufficient quantity, and being adapted, to abrade fabrics when pellets are washed with fabrics; and washing fabric in hot water in the presence of said pellets.

2. The method of claim 1 wherein the step of providing pliable plastic pellets further comprises the step of combining polyvinylchloride resin and bis (2-ethylhexyl) terephthalata to form the pellets.

3. The method of claim 1 wherein in said step of providing pliable plastic pellets, said abrasive filler is aluminum trihydrate.

4. The method of claim 1 wherein said step of providing pliable plastic pellets further comprises the step of forming a mixture comprised of between about 43 and 53% by weight plastic resin, 17 and 27% by weight plasticizer, and 25 and 35% by weight abrasive filler to form the pellets.

5. The method of claim 1 wherein said step of providing pliable plastic pellets further comprising the step of forming a mixture comprised of 48% by weight plastic resin, 22% by weight plasticizer and 30% by weight abrasive filler to form the pellets.

6. The method of claim 1 wherein said step of providing pliable plastic pellets, further comprises the steps of combining a plastic resin, plasticizer and abrasive filler at a sufficiently high temperature to maintain such combination in a liquid state and extruding said mixture at a temperature between about 310° and 320° F. to form the pellets.

7. A method for the abrasive treatment of fabrics comprising the steps of:

manufacturing pliable abrasive plastic pellets having a desired cross-sectional shape and length, said step of manufacturing comprising the further steps of:

preparing a mixture comprised of plastic resin, abrasive filler and plasticizer at a temperature sufficient to maintain the mixture in a liquid state;

extruding the mixture through a dye having a shape corresponding to the desired cross-sectional shape of the pellets at a temperature which will provide for the presence of bubbles in the mixture during said extruding such that the mixture hardens in a porous state after it exits the die; and cutting the extruded mixture at intervals corresponding to the desired length of the pellets;

combining said manufactured pellets with the fabric in hot water; and agitating said combination of pellets, fabric and hot water to abrasively treat fabric.

8. The method of claim 7 wherein the step of preparing the mixture further comprises:

combining between about 43 and 53 percent by weight plastic resin, 17 and 27 percent by weight plasticizer and 25 and 35 percent by weight abrasive filler at a temperature between about 310° and 320° F.

* * * * *